US011302495B2

(12) United States Patent
Yoshii

(10) Patent No.: US 11,302,495 B2
(45) Date of Patent: Apr. 12, 2022

(54) SWITCH APPARATUS

(71) Applicant: DENSO TEN Limited, Kobe (JP)

(72) Inventor: Syohhei Yoshii, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 17/140,651

(22) Filed: Jan. 4, 2021

(65) Prior Publication Data

US 2021/0241982 A1 Aug. 5, 2021

(30) Foreign Application Priority Data

Feb. 4, 2020 (JP) ..... JP2020-017513

(51) Int. Cl.
*H01H 13/14* (2006.01)
*H01H 13/02* (2006.01)
*H01H 13/04* (2006.01)

(52) U.S. Cl.
CPC ..... *H01H 13/023* (2013.01); *H01H 13/04* (2013.01); *H01H 13/14* (2013.01)

(58) Field of Classification Search
CPC ..... H01H 13/83; H01H 2219/062; H01H 13/023; H01H 2219/036; H01H 2219/06; H01H 2219/064; H01H 9/161; H01H 2219/044; H01H 2219/066; H01H 13/04; H01H 9/182; H01H 2219/014; H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS 9,086,733 B2 * 7/2015 Pance ..... G06F 3/0202
2007/0295588 A1 * 12/2007 Kamata ..... H01H 13/83 200/341
2017/0194118 A1 * 7/2017 Brudzynsky ..... H01H 23/025
2020/0098532 A1 * 3/2020 Liang ..... G06F 3/0202
2021/0050163 A1 * 2/2021 Guerrero, Jr. ..... H01H 1/26

FOREIGN PATENT DOCUMENTS

JP 2014-067674 A 4/2014

* cited by examiner

*Primary Examiner* — Ahmed M Saeed
(74) *Attorney, Agent, or Firm* — Oliff PLC

(57) ABSTRACT

A switch apparatus according to one embodiment includes an operation portion, a surface film and a light source. The operation portion has an elongated shape with first and second opposite ends in a longitudinal direction of the operation portion, receives a pressing operation of a user at least at one of the first and second ends, and is translucent. The surface film is formed on a surface of the operation portion and is translucent. The light source is arranged on a back-surface side of the operation portion and emits light toward the at least one of the first and second ends.

5 Claims, 10 Drawing Sheets

81

| INFORMA -TION ID | OPERATION CONTENT | OPERATION MODE OF LIGHT SOURCE, ETC. | ... |
|---|---|---|---|
| A01 | VOLUME ADJUSTMENT | OPERATION MODE B01 | ... |
| A02 | MENU SELECTION | OPERATION MODE B02 | ... |
| ... | ... | ... | ... |

FIG. 7

SWITCH APPARATUS

BACKGROUND OF THE INVENTION

Field of the Invention

The invention relates to a switch apparatus and an in-vehicle apparatus.

Description of the Background Art

Conventionally, various technologies as to a switch apparatus of an in-vehicle apparatus such as an audio device or an air-conditioner mounted on a vehicle have been proposed (for example, refer to Japanese Published Unexamined Patent Application No. 2014-067674. In such a conventional technology, light is emitted from a back-surface side of a switch having a circular shape to improve operability of the switch, and the like. In the conventional technology, the light is emitted to a knob having a circular shape constituting the switch.

However, in the conventional technology, there is still room for improvement in the operability. Namely, in some cases, for example, in a switch apparatus, an operation portion is configured to receive a pressing operation of a user at a part of the operation portion (such as an end of the operation portion) according to a shape of the operation portion to be operated by the user. In such a switch operation, for example, when it is dark inside the vehicle at night, it becomes difficult for the user to see a position of the part (such as the end) to be press-operated in the operation portion. As a result, the operability of the switch apparatus may be lowered. The operability of the switch apparatus may also be lowered, for example, when it is bright inside the vehicle during the daytime.

SUMMARY OF THE INVENTION

According to one aspect of the invention, a switch apparatus includes an operation portion that has an elongated shape with first and second opposite ends in a longitudinal direction of the operation portion, receives a pressing operation of a user at least at one of the first and second ends, and is translucent, a surface film that is formed on a surface of the operation portion and is translucent, and a light source that is arranged on a back-surface side of the operation portion and emits light toward the at least one of the first and second ends.

An object of the invention is to provide a switch apparatus and an in-vehicle apparatus capable of improving operability.

These and other objects, features, aspects and advantages of the invention will become more apparent from the following detailed description of the invention when taken in conjunction with the accompanying drawings.

BRIEF DESCRIPTION OF THE DRAWINGS

FIG. 7 illustrates one example of an operation mode information;

DESCRIPTION OF THE EMBODIMENTS

Embodiments of a switch apparatus and an in-vehicle apparatus disclosed in this application will be described in detail with reference to the accompanying drawings. This invention is not limited to the embodiments described below.

First Embodiment

Figure 1:
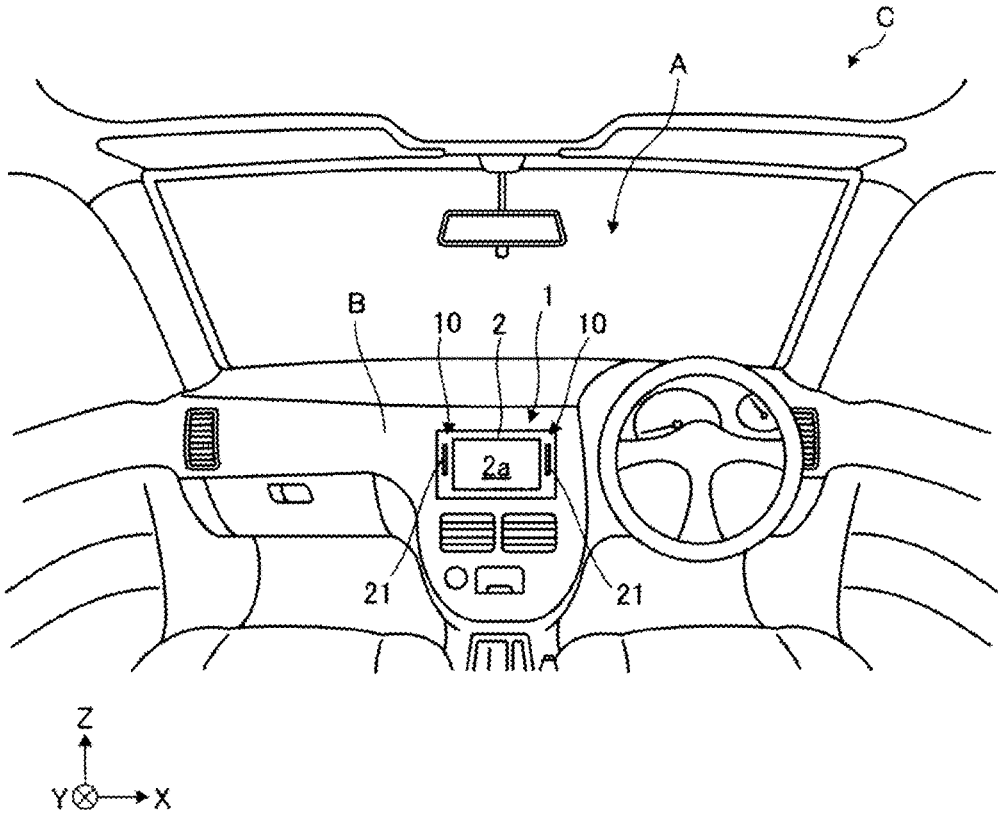
FIG. 1 illustrates an in-vehicle apparatus including a switch apparatus according to a first embodiment.

First, a configuration of an in-vehicle apparatus including a switch apparatus according to a first embodiment will be described with reference to FIG. 1. FIG. 1 illustrates the in-vehicle apparatus including the switch apparatus according to the first embodiment. FIG. 1 illustrates a state in front of a vehicle C when viewed from an inside of a vehicle cabin A of the vehicle C. FIG. 1 is a schematic diagram and the drawings after FIG. 2 described later also include schematic diagrams.

For convenience of illustration, FIG. 1 shows a three-dimensional orthogonal coordinate system including a Z-axis in which a vertical upward direction is a positive direction and a vertical downward direction is a negative direction, an X-axis that is a vehicle width direction, and a Y-axis that is a vehicle length direction. The orthogonal coordinate system may be shown in other drawings described later.

As illustrated in FIG. 1, an in-vehicle apparatus 1 is provided in an instrument panel B of the vehicle C. For example, the in-vehicle apparatus 1 has an audio function, but the invention is not limited thereto. That is, the in-vehicle apparatus 1 may have other functions in addition to or instead of the audio function, for example, a car navigation function.

The in-vehicle apparatus 1 includes a display apparatus 2 and a switch apparatus 10. The display apparatus 2 is, for example, a liquid crystal display including a display screen 2*a*. For example, various information as to audio and car navigation is displayed on the display screen 2*a*.

The switch apparatus 10 is an input apparatus that inputs an operation of a user, such as an operation for instructing the in-vehicle apparatus 1 to operate. The user is, for example, an occupant of the vehicle C.

The switch apparatus 10 includes an operation portion 21 that is press-operated by the user. Here, in one example, the operation portion 21 has an elongated shape with first and second opposite ends in a longitudinal direction of the operation, and is configured to receive a pressing operation of the user at least at one of the first and second ends (e.g., an upper or lower end in a Z-axis direction). In this case, for example, when it is dark inside the vehicle cabin A at night, it becomes difficult for the user to see a position of a part to be press-operated in the operation portion 21. As a result, operability of the switch apparatus 10 may be lowered.

Therefore, the switch apparatus 10 according to this embodiment is configured to improve the operability. Specifically, in this embodiment, the part (e.g., end) to be operated in the operation portion 21 is brightly illuminated, thereby improving the operability.

Figure 2:
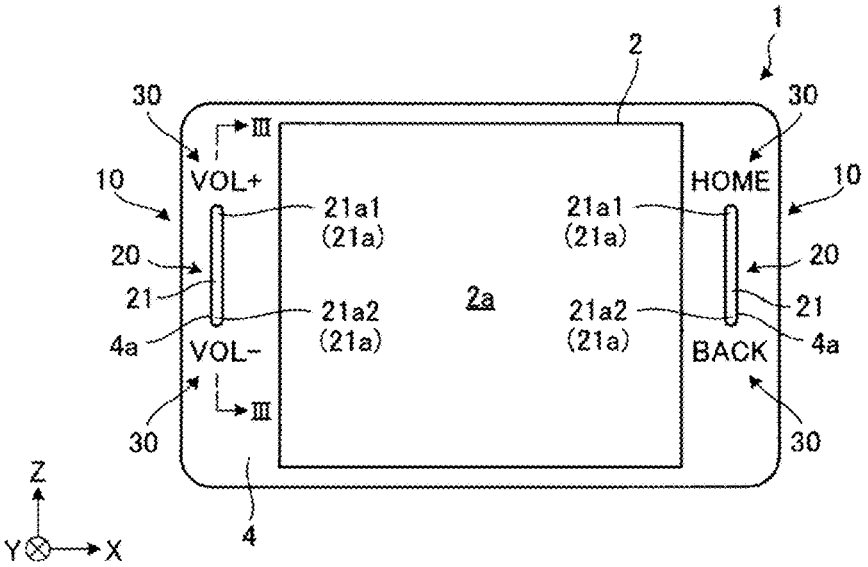
FIG. 2 is an enlarged view of the in-vehicle apparatus.

Hereinafter, the configuration will be described in detail with reference to the drawings after FIG. 2. FIG. 2 is an enlarged view of the in-vehicle apparatus 1. As illustrated in FIG. 2, the switch apparatus 10 is provided in a panel 4 that surrounds a periphery of the display apparatus 2. In an example of FIG. 2, the switch apparatus 10 is provided on each of left and right sides in the vehicle width direction (X-axis direction) relative to the display apparatus 2, but a number and position of the switch apparatus 10 may be arbitrarily set.

The switch apparatus 10 includes a switch 20 and a displaying portion 30. The displaying portion 30 displays characters and the like corresponding to the operation of the switch 20. For example, when the pressing operation to the switch 20 is an operation for increasing sound volume of the in-vehicle apparatus 1, a character string such as "VOL+" is displayed in a position corresponding to a vicinity of the switch 20 in the panel 4 as the displaying portion 30. In the displaying portion 30, characters do not need to be displayed, and for example, marks or figures may be displayed. The displaying portion 30 is configured so that characters and the like are displayed by light from a back-surface side of the panel 4. This will be described later.

The switch 20 includes the operation portion 21 described above. The operation portion 21 is arranged in an opening 4*a* formed in the panel 4 and receives the pressing operation by the user. For example, the operation portion 21 having an elongated shape (i.e., a rod shape) is configured to selectively receive the pressing operation at both of first and second ends 21*a* in the longitudinal direction. That is, the switch 20 is a seesaw switch.

Hereinafter, out of the first and second ends 21*a* of the operation portion 21, one of the first and second ends 21*a* in the Z-axis positive direction is referred to as "one end 21*a*1" and the other one of the first and second ends 21*a* in the Z-axis negative direction is referred to as "the other end 21*a*2". However, the one end 21*a*1 and the other end 21*a*2 are referred to as "end 21*a*" when description is made without distinguishing individual ends.

Figure 3:
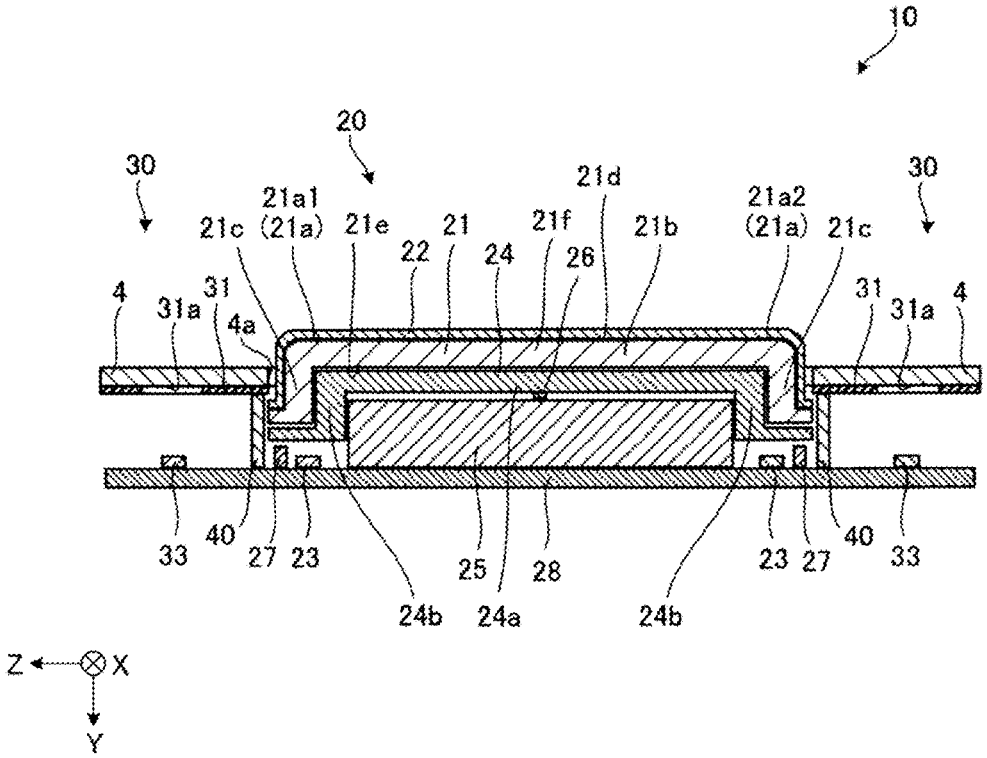
FIG. 3 is a sectional view taken along line III-III of FIG. 2.

Here, the switch 20 and the like are further described in detail with reference to FIG. 3. FIG. 3 is a sectional view taken along line III-III of FIG. 2. As illustrated in FIG. 3, the switch 20 includes the operation portion 21 described above, a surface film 22, a light source 23, a light guide 24, a light shield 25, a support portion 26, a sensor 27, and a substrate 28.

The operation portion 21 includes an extension portion 21*b* that extends along the longitudinal direction (Z-axis direction), the end 21*a* of the operation portion 21, in other words, a wall 21*c* that extends toward the back-surface side of the panel 4 from the end 21*a* of the extension portion 21*b*. The operation portion 21 is arranged so that the extension portion 21*b* is exposed from the opening 4*a* of the panel 4 and a part or the whole of the wall 21*c* is positioned inside the panel 4.

As described above, the operation portion 21 receives the pressing operation at the one end 21*a*1 or the other end 21*a*2. Furthermore, the operation portion 21 is translucent. For example, the operation portion 21 is formed so as to pass light emitted from the light source 23 described later. The operation portion 21 is formed of transparent resin, but the invention is not limited thereto. That is, the operation portion 21 may have other colors such as milk-white and may be formed of other materials other than resin.

The surface film 22 is formed on a surface 21*d* of the operation portion 21 and is translucent. Specifically, the surface film 22 is a half-mirror film. That is, the surface film 22 is, for example, configured to reflect a part of the light that is emitted from the light source 23 and is entered through the operation portion 21 and to pass the other part of the light. Each of reflectivity and transmissivity of the surface film 22 is set to an arbitrary value.

The surface film 22 is formed on the surface 21*d*, for example, by a plating deposition process. For the surface film 22, for example, satin plating may be used, but the invention is not limited thereto. For example, other types of plating, such as chromium plating, may be used. In the above, the surface film 22 is formed, for example, by the deposition process, but the invention is not limited thereto. The surface film 22 is formed by other methods, such as coating.

Figure 4:
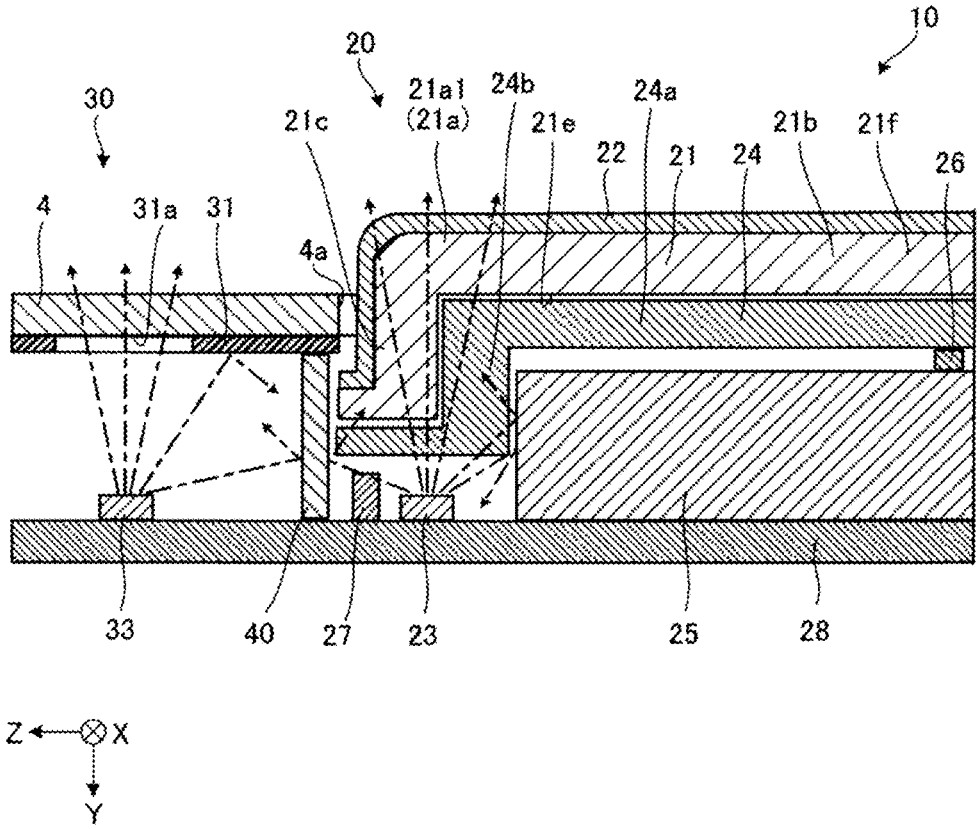
FIG. 4 is an enlarged view of a vicinity of a light source of the switch apparatus.

The light source 23 is arranged on a side of a back surface 21*e* of the operation portion 21. Here, description of the light source 23 will be followed with reference to FIG. 4. FIG. 4 is an enlarged view of a vicinity of the light source 23 of the switch apparatus 10.

As illustrated in FIG. 4, the light source 23 is arranged on the side of the back surface 21*e* of the operation portion 21, specifically, on the side of the back surface 21*e* of the end 21*a* that can receive the pressing operation in the operation portion 21. As shown by an alternate long and short dash line, the light source 23 emits the light toward the end 21*a*. For example, an LED may be used for the light source 23.

Figure 5:
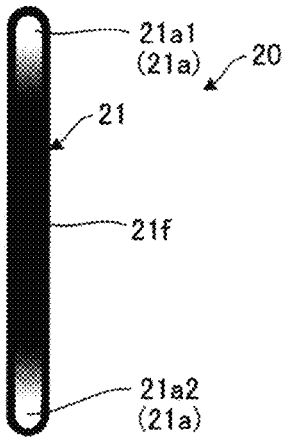
FIG. 5 illustrates an operation portion to which light is emitted from a light source.

FIG. 5 illustrates the operation portion 21 to which the light is emitted from the light source 23. For convenience of illustration, FIG. 5 shows a part that becomes bright by the light from the light source 23 with a white color and a part that does not become bright by the light from the light source 23 with a black color.

In this embodiment, since the operation portion 21 and the surface film 22 are translucent and the light source 23 emits the light toward the end 21*a*, as illustrated in FIG. 4 and FIG. 5, the end 21*a* is brightly illuminated. As a result, for example, even when it is dark inside the vehicle cabin A at night, it becomes easy for the user to see the position of the part (here, the end 21*a*) to be press-operated in the operation portion 21 so that the operability of the switch apparatus 10 is improved.

Furthermore, the light emitted toward the end 21*a* becomes weak as it is away from the end 21*a*. Therefore, since the operation portion 21 has a gradation that becomes gradually darker from the end 21*a* to a central portion 21*f* as it is away from the end 21*a*, appearance of the operation portion 21 is improved and design of the operation portion 21 is also improved.

Furthermore, as illustrated in FIG. 3, there is a plurality (here, two) of the light sources 23 and the two light sources 23 are respectively arranged at the both ends 21*a* of the operation portion 21, that is, on the sides of the back surfaces 21*e* of the one end 21*a*1 and the other end 21*a*2. The light sources 23 emit the light toward the both ends 21*a*.

As a result, the both ends 21*a* of the operation portion 21 are brightly illuminated (refer to FIG. 5). Thus, since it becomes easy for the user to see the positions of the one end

21*a*1 and the other end 21*a*2 to be press-operated in the operation portion 21, the operability of the switch apparatus 10 is further improved.

Since the surface film 22 according to this embodiment is, as described above, a half-mirror film, for example, the operation portion 21 on which the surface film 22 is formed is brightly illuminated by the light passing through the surface film 22 when the light is emitted from the light sources 23. On the other hand, when the light is not emitted from the light sources 23, a color of the operation portion 21 changes to a color of the surface film 22 (e.g., silver as one example of plating colors) so that the light sources 23 that exist on the sides of the back surfaces 21*e* of the operation portion 21 are prevented from being seen by the user inside the vehicle cabin A. Thus, the design of the operation portion 21 is further improved.

Since the surface film 22 is formed by the deposition process, the surface film has a relatively thin and uniform or substantially uniform thickness. As a result, it is possible to suppress unevenness of the light passing through the surface film 22 and to further improve the design of the operation portion 21.

As illustrated in FIG. 3, the light guide 24 is arranged between the operation portion 21 and the light source 23. For example, the light guide 24 is a light guide plate having a plate shape and includes an extension portion 24*a* and a wall 24*b*. The extension portion 24*a* extends along the longitudinal direction (Z-axis direction) of the operation portion 21 on the back surface 21*e* of the operation portion 21. The wall 24*b* extends toward an inside of the panel 4 from an end of the extension portion 24*a*. The wall 24*b* is formed along the wall 21*c* of the operation portion 21.

The light guide 24 is translucent and guides the light emitted from the light source 23 to the operation portion 21 (refer to FIG. 4). The light guide 24 is formed of transparent resin, but the invention is not limited thereto.

The light guide 24 configured as described above diffuses and uniformizes the light emitted from the light source 23 and guides the light to the end 21*a* of the operation portion 21. Therefore, the appearance of the gradation in a vicinity of the end 21*a* of the operation portion 21 is improved and the design of the operation portion 21 is further improved.

The light shield 25 is arranged on the side of the back surface 21*e* of the operation portion 21. For example, the light shield 25 is arranged on the side of the back surface 21*e* of a predetermined area including the central portion 21*f* of the operation portion 21. The light guide 24 is arranged between the light shielding 25 and the operation portion 21.

The light shield 25 has light shielding property. The light shield 25 is formed of resin having light shielding property, but the invention is not limited thereto.

The light shield 25 configured as described above shields the light going from the light source 23 to the central portion 21*f* of the operation portion 21 (refer to FIG. 4). As a result, the light does not reach the central portion 21*f* of the operation portion 21. Thus, since the operation portion 21 has a gradation that becomes gradually darker from the end 21*a* to the central portion 21*f*, the appearance of the operation portion 21 is improved and the design of the operation portion 21 is further improved.

The support portion 26 supports the operation portion 21 and the light guide 24 in a vicinity of the central portion 21*f*. Since the switch 20 is, as described above, a seesaw switch, when one of the both ends 21*a* of the operation portion 21 is press-operated, the support portion 26 functions as a fulcrum. Thus, it is possible to rotate (swing) the operation portion 21 and the light guide 24 around the X-axis.

The support portion 26 may be configured integrally with the light guide 24 or may be configured integrally with the light shield 25. The support portion 26 may be configured separately from the light guide 24 and the light shield 25.

The sensor 27 detects the pressing operation to the end 21*a* of the operation portion 21. There is a plurality (here, two) of the sensors 27 and the two sensors 27 are respectively arranged at the both ends 21*a* of the operation portion 21, that is, on the sides of the back surfaces 21*e* of the one end 21*a*1 and the other end 21*a*2.

The substrate 28 is arranged inside the panel 4. The light source 23 and the sensor 27 described above are mounted on the substrate 28.

Next, the displaying portion 30 will be described with reference to FIG. 3 and FIG. 4. The displaying portion 30 includes a light shielding film 31 and a light source for the displaying portion 33. The light shielding film 31 has light shielding property and is formed on the back-surface side of the panel 4. The light shielding film 31 is, for example, formed on the back-surface side of the panel 4 by coating, but the invention is not limited thereto.

The light shielding film 31 is provided with a cut-out portion 31*a* corresponding to the characters of the displaying portion 30. Specifically, the light shielding film 31 is, for example, provided with the cut-out portion 31*a* having a shape of the character string such as "VOL+".

The light source for the displaying portion 33 is arranged on the back-surface side of the panel 4, specifically, a back-surface side of the cut-out portion 31*a* of the light shielding film 31. As shown by an alternate long and short dash line in FIG. 4, the light source for the displaying portion 33 emits the light toward the cut-out portion 31*a* of the light shielding film 31. As a result, although illustration is omitted, the characters of the displaying portion 30 are displayed on the panel 4 by the light from the back-surface side. For example, an LED may be used for the light source for the displaying portion 33.

As illustrated in FIG. 4 and the like, a light shielding wall 40 is provided between the light source for the displaying portion 33 and the light source 23 on the back-surface side of the panel 4. For example, the light shielding wall 40 has light shielding property and is raised from the substrate 28 to the panel 4. As a result, the light from the light source 23 is suppressed from being leaked to a side of the displaying portion 30 and the light from the light source for the displaying portion 33 is suppressed from being leaked to a side of the switch 20.

As described above, in this embodiment, the switch 20 is a seesaw switch in which the operation portion 21 is configured to selectively receive the pressing operation at the both ends 21*a*. Since the both ends 21*a* of the seesaw switch are brightly illuminated, the operability of the switch apparatus 10 is improved.

In the above, the operation portion 21 is configured to receive the pressing operation at the both ends 21*a*, but the invention is not limited thereto. For example, the operation portion 21 may be configured to receive the pressing operation at one of the both ends 21*a*.

Figure 6:
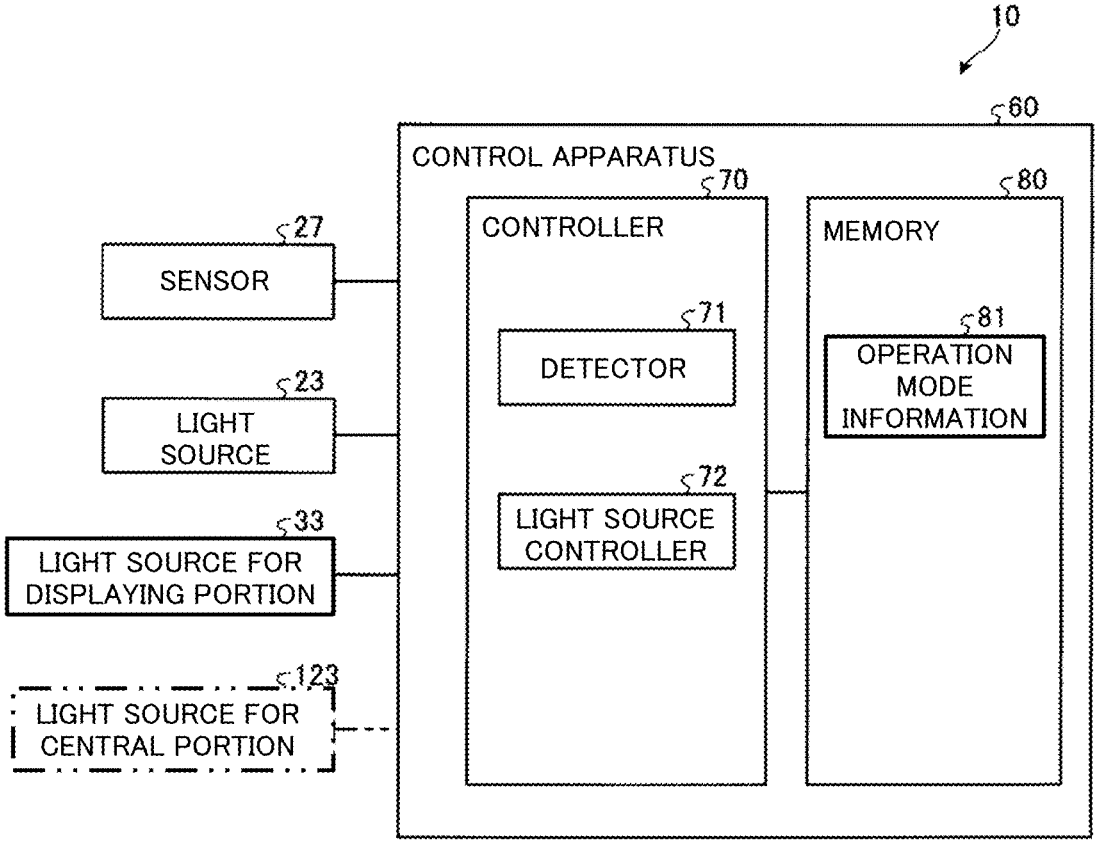
FIG. 6 is a block diagram illustrating a configuration example of the switch apparatus.

Next, control of the light source 23, etc. in the switch apparatus 10 according to this embodiment will be described with reference to FIG. 6. FIG. 6 is a block diagram illustrating a configuration example of the switch apparatus 10 according to this embodiment. In the block diagrams of FIG. 6 and the like, only elements necessary to describe the features of this embodiment are illustrated as functional blocks, and general elements are not illustrated for simplicity purposes.

In other words, each element illustrated in FIG. 6 is just functional and conceptual, and is not necessarily configured as illustrated in a physical sense. For example, a distributed and/or integrated version of each functional block is not limited to those illustrated, and its entirety or a part thereof may be functionally or physically distributed or integrated in an arbitrary unit according to various loads, use situations, and the like.

As illustrated in FIG. 6, the switch apparatus 10 includes a control apparatus 60. The sensor 27, the light source 23, and the light source for the displaying portion 33 described above, and the like, are connected to the control apparatus 60.

The control apparatus 60 includes a controller 70 and a memory 80. The controller 70 includes a detector 71 and a light source controller 72. The controller 70 includes a computer having, for example, a CPU (Central Processing Unit), a ROM (Read Only Memory), a RAM (Random Access Memory), an HDD (Hard Disk Drive), an input/output port, and the like, and various circuits.

The CPU of the computer reads out and executes a program stored in the ROM, for example, so as to function as the detector 71 and the light source controller 72 of the controller 70.

At least one or all of the detector 71 and the light source controller 72 of the controller 70 may be constituted of hardware such as an ASIC (Application Specific Integrated Circuit) and a FPGA (Field Programmable Gate Array).

The memory 80 is, for example, realized by a semiconductor memory element such as a RAM or a flash memory, or a storage device such as a hard disk or an optical disk. In an example of FIG. 6, operation mode information 81 is stored in the memory 80.

The operation mode information 81 relates to, for example, an operation mode of the light source 23 or the light source for the displaying portion 33. FIG. 7 illustrates one example of the operation mode information 81. As illustrated in FIG. 7, in the operation mode information 81, "information ID", "operation content", "operation mode of light source, etc." and other information are associated with each other.

The "information ID" indicates an identifier indicating information about the operation mode. The "operation content" is information indicating the operation content corresponding to the pressing operation to the end 21*a* of the operation portion 21. Specifically, the "operation content" is an operation instruction to the in-vehicle apparatus 1 performed by the pressing operation to the end 21*a*. In one example, the "operation content" includes a volume adjustment, menu selection of radio menus and navigation menus, and the like.

The "operation mode of light source, etc." is information indicating the operation mode of the light source 23, etc. according to the operation content. In an example of FIG. 7, an abstract description such as "operation mode B01" is made for the "operation mode of light source, etc." for convenience of illustration, but specific information is stored for the "operation mode B01". A specific operation mode in the "operation mode of light source, etc." will be described later.

In the example of FIG. 7, data that is identified by the information ID "A01" indicates that the operation content is "volume adjustment" and the operation mode of the light source, etc. is the "operation mode B01".

Referring back to FIG. 2, the detector 71 of the controller 70 detects a state of the vehicle C. For example, when a light switch (not shown) is turned on, the detector 71 detects a state in which a tail lamp of the vehicle C is turned on. That is, the detector 71 detects a state in which it is estimated to be relatively dark inside the vehicle cabin A at night. The detector 71 outputs a signal indicating a detection result of the state of the vehicle C to the light source controller 72.

In the above, the detector 71 detects the state of the vehicle cabin A based on a lighting state of the tail light, but the invention is not limited thereto. That is, for example, the detector 71 may detect the state of the vehicle cabin A based on an output of an illuminance sensor provided in the vehicle cabin A or an input operation by the user.

The detector 71 detects the pressing operation to the end 21*a* of the operation portion 21. For example, the detector 71 detects the pressing operation to the end 21*a* based on an output of the sensor 27. The detector 71 outputs a signal indicating a detection result of the pressing operation to the end 21*a* to the light source controller 72.

The detector 71 further outputs a signal indicating that the end 21*a* has been press-operated to the in-vehicle apparatus 1. As a result, in the in-vehicle apparatus 1, operation control corresponding to the pressing operation is performed. That is, for example, when the pressing operation to the end 21*a* of the operation portion 21 is an operation for instructing an increase of sound volume, in the in-vehicle apparatus 1, the operation control for increasing the sound volume is performed.

The light source controller 72 controls operations of the light source 23 and the light source for the displaying portion 33, and the like. For example, when the state in which it is estimated to be relatively dark inside the vehicle cabin A has been detected by the detector 71, the light source controller 72 determines that it is a timing to turn on the light source 23, etc. and turns on the light source 23 and the light source for the displaying portion 33, etc.

In the above, the light source controller 72 turns on the light source 23 and the light source for the displaying portion 33, etc. according to the state of the vehicle cabin A, but the invention is not limited thereto. That is, for example, the light source controller 72 may turn on the light source for the displaying portion 33 regardless of the state of the vehicle cabin A. Furthermore, the light source controller 72 may turn on the light source 23 and the light source for the displaying portion 33 regardless of the state of the vehicle cabin A.

The light source controller 72 may control the operation modes of the light source 23, etc. according to the operation content corresponding to the pressing operation to the end 21*a* based on the operation mode information 81.

As a result, according to this embodiment, a mode of illumination of the end 21*a* of the operation portion 21 may be changed according to the operation content. Therefore, the user may visually inspect and grasp the operation content by the mode of the illumination of the end 21*a* of the operation portion 21, and thus, the operability of the switch apparatus 10 is further improved.

For example, the light source controller 72 may control brightness of the light source 23 according to the operation content corresponding to the pressing operation to the end 21*a* of the operation portion 21.

In one example, when the operation content corresponding to the pressing operation to the one end 21*a*1 of the operation portion 21 is "to increase sound volume", the light source controller 72 may perform control to increase luminance of the light source 23 corresponding to the one end 21*a*1 to increase brightness of the one end 21*a*1 according to a number of times of the pressing operation to the one end 21*a*1. On the other hand, when the operation content corresponding to the pressing operation to the other end 21*a*2 of the operation portion 21 is "to decrease sound volume", the light source controller 72 may perform control to decrease the luminance of the light source 23 corresponding to the other end 21*a*2 to decrease brightness of the other end 21*a*2 according to the number of times of the pressing operation to the other end 21*a*2.

As a result, according to this embodiment, it is possible to change the brightness of the end 21*a* of the operation portion 21 according to the operation content. Therefore, the user may visually inspect and grasp the operation content by the brightness of the end 21*a* of the operation portion 21, and thus, the operability of the switch apparatus 10 is further improved.

The light source controller 72 may control such that the operation mode of the light source 23 is differentiated between one end 21*a* of the both ends 21*a* at which the operation corresponding to the pressing operation is valid and the other end 21*a* at which the operation corresponding to the pressing operation is invalid.

Specifically, here, the operation content corresponding to the pressing operation to the end 21*a* of the operation portion 21 is classified into a plurality of classes. For example, the plurality of the classes includes a high class, a middle class and a low class. For example, the operation content in the high class is an operation for selecting the radio menus and the navigation menus, the operation content in the middle class when the radio menus are selected is an operation for selecting an FM broadcast or an AM broadcast, and the operation content in the low class when the FM broadcast is selected is an operation for selecting a radio station. The pressing operation to the one end 21*a*1 of the both ends 21*a* is an operation for shifting an operation mode of the in-vehicle apparatus 1 from the low class to the middle class or from the middle class to the high class. The pressing operation to the other end 21*a*2 is an operation for shifting the operation mode of the in-vehicle apparatus 1 from the high class to the middle class or from the middle class to the low class.

In the switch apparatus 10 configured as described above, for example, when an operation state of the in-vehicle apparatus 1 is in the high class, since there is no higher class than the high class, the operation corresponding to the pressing operation to the one end 21*a*1 is invalid. Namely it is a state in which there is no reaction even when any operation is performed. Since there is the middle class lower than the high class, the operation corresponding to the pressing operation to the other end 21*a*2 is valid.

At this time, the light source controller 72 turns off the light source 23 corresponding to the one end 21*a*1 to inform the user that the operation corresponding to the pressing operation to the one end 21*a*1 is invalid. On the other hand, the light source controller 72 turns on the light source 23 corresponding to the other end 21*a*2 to inform the user that the operation corresponding to the pressing operation to the other end 21*a*2 is valid. Namely, when the light source controller 72 performs such an operation, the light source controller 72 informs the user that it is a state in which there is any reaction.

As described above, the light source controller 72 controls such that the operation mode of the light source 23 is differentiated between the one end 21*a* at which the operation corresponding to the pressing operation is valid and the other end 21*a* at which the operation corresponding to the pressing operation is invalid. Therefore, the user may visually inspect and grasp whether the operation corresponding to the end 21*a* is valid or invalid by the mode of the illumination of the end 21*a*, and thus, the operability of the switch apparatus 10 is further improved.

Figure 8:
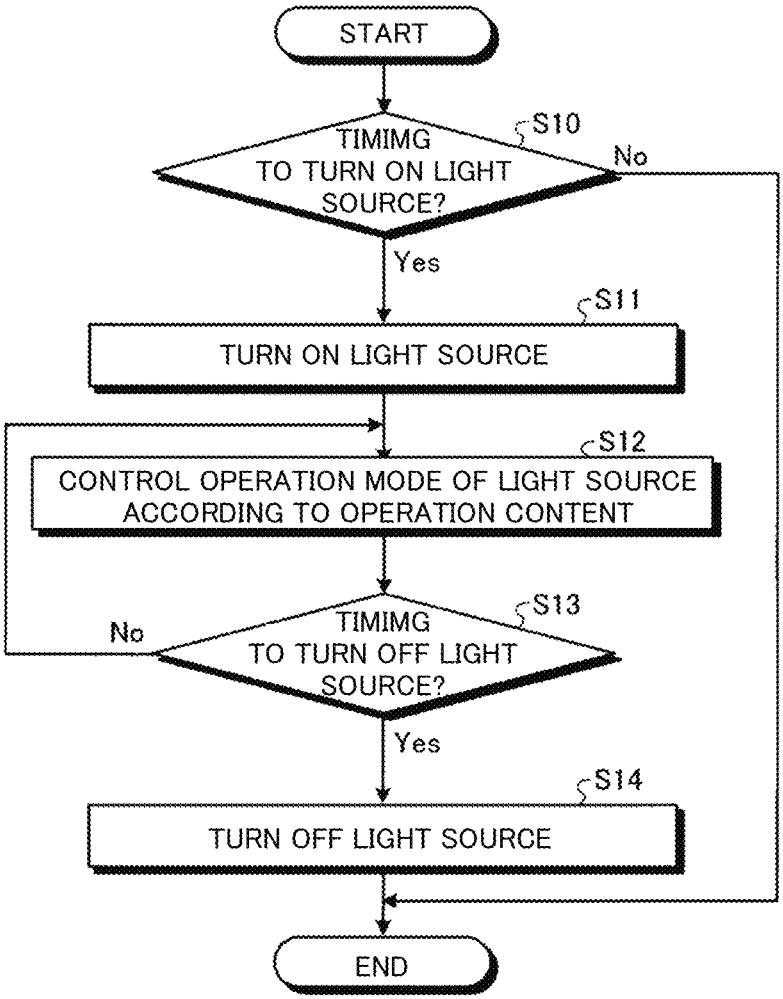
FIG. 8 is a flowchart illustrating a processing procedure executed by a control apparatus of the switch apparatus.

Next, a specific processing procedure in the switch apparatus 10 will be described with reference to FIG. 8. FIG. 8 is a flowchart illustrating a processing procedure executed by the control apparatus 60 of the switch apparatus 10. FIG. 8 illustrates a processing procedure as to the light source 23.

As illustrated in FIG. 8, the controller 70 of the control apparatus 60 determines whether or not it is a timing to turn on the light source, for example, based on the detection result of the state of the vehicle C (a step S10). When it is determined that it is not a timing to turn on the light source 23 (No in the step S10), the controller 70 skips the following processing.

On the other hand, when it is determined that it is a timing to turn on the light source 23 (Yes in the step S10), the controller 70 turns on the light source 23 (a step S11).

Subsequently, the controller 70 controls the operation mode of the light source 23 according to the operation content corresponding to the pressing operation to the end 21*a* of the operation portion (a step S12). Subsequently, the controller 70 determines whether or not it is a timing to turn off the light source 23, for example, based on the detection result of the state of the vehicle C (a step S13). When it is determined that it is not a timing to turn off the light source 23 (No in the step S13), the controller 70 returns to the step S12.

On the other hand, when it is determined that it is a timing to turn off the light source 23 (Yes in the step S13), the controller 70 turns off the light source 23 (a step S14).

As described above, the switch apparatus 10 according to the first embodiment includes the operation portion 21, the surface film 22, and the light source 23. The operation portion 21 has an elongated shape with first and second opposite ends in a longitudinal direction of the operation portion, receives the pressing operation of the user at least at one of the first and second ends 21*a*, and is translucent. The surface film 22 is formed on the surface 21*d* of the operation portion 21 and is translucent. The light source 23 is arranged on the side of the back surface 21*e* of the operation portion 21 and emits the light toward the at least one of the first and second ends 21*a*. As a result, it is possible to improve the operability of the switch apparatus 10.

Second Embodiment

Figure 9:
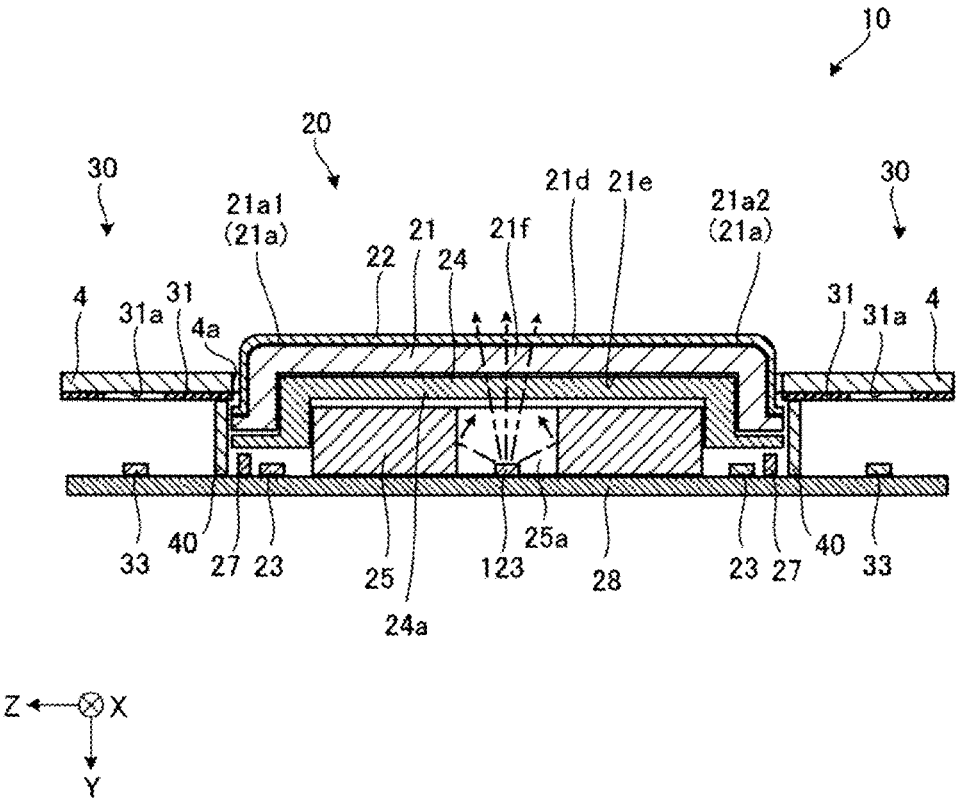
FIG. 9 is a sectional view of a switch according to a second embodiment.

Subsequently, a second embodiment will be described with reference to FIG. 9. FIG. 9 is a sectional view of a switch 20 according to the second embodiment. As illustrated in FIG. 9, according to the second embodiment, an operation portion 21 of the switch 20 is configured to receive a pressing operation at a central portion 21*f* in addition to an end 21*a*.

Specifically, the switch 20 according to the second embodiment includes a light source for a central portion 123. The light source for the central portion 123 is arranged on a side of a back surface 21*e* of the operation portion 21. Specifically, the light source for the central portion 123 is arranged on the side of the back surface 21*e* of the operation portion 21, more specifically, on the side of the back surface 21*e* of the central portion 21*f* that can receive the pressing operation in the operation portion 21.

In the light shield 25 described above, the light source for the central portion 123 is arranged inside a space 25*a* that is formed in a position corresponding to the central portion 21*f* of the operation portion 21. The light shield 25 may be formed of an elastic member (e.g., rubber member) that is elastically deformed when receiving the pressing operation to the central portion 21*f* of the operation portion 21. The light source for the central portion 123 is mounted on a substrate 28.

As shown by an alternate long and short dash line, the light source for the central portion 123 emits light toward the central portion 21*f*. As a result, the light emitted from the light source for the central portion 123 passes through a light guide 24, the operation portion 21, and a surface film 22.

Since the light source for the central portion 123 is arranged within the space 25*a* of the light shield 25, the light going from the light source for the central portion 123 to the end 21*a* is shielded by the light shield 25. For example, an LED may be used for the light source for the central portion 123. The light source for the central portion 123 is one example of a second light source.

Figure 10:
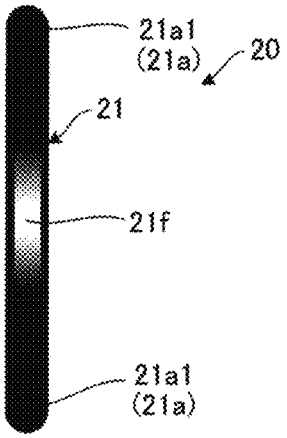
FIG. 10 illustrates an operation portion to which light is emitted from a light source for a central portion.

FIG. 10 illustrates the operation portion 21 to which the light is emitted from the light source for the central portion 123. As illustrated in FIG. 10, according to the second embodiment, since the operation portion 21 and the surface film 22 are translucent and the light source for the central portion 123 emits the light toward the central portion 21*f*, the central portion 21*f* is brightly illuminated. As a result, for example, even when it is dark inside a vehicle cabin A at night, it becomes easy for the user to see a position of a part (here, the central portion 21*f*) to be press-operated in the operation portion 21 so that the operability of the switch apparatus 10 is improved.

Furthermore, the light emitted toward the central portion 21*f* becomes weak as it is away from the central portion 21*f*. Therefore, since the operation portion 21 has a gradation that becomes gradually darker from the central portion 21*f* to the end 21*a* as it is away from the central portion 21*f*, appearance of the operation portion 21 is improved and design of the operation portion 21 is also improved.

The pressing operation to the central portion 21*f* of the operation portion 21 is detected by two sensors 27 (refer to FIG. 9). That is, for example, when the pressing operation to the central portion 21*f* is performed, both ends 21*a* move to sides of the two sensors 27. Therefore, when the two sensors 27 detect the pressing operation, the pressing operation to the central portion 21*f* may be detected.

Although illustration is omitted, a new sensor that detects the pressing operation to the central portion 21*f* of the operation portion 21 may be provided without using the two sensors 27.

Next, control of the light source for the central portion 123, etc. in the switch apparatus 10 according to the second embodiment will be described with reference to FIG. 6.

According to the second embodiment, as illustrated by an imaginary line in FIG. 6, the light source for the central portion 123 is connected to a control apparatus 60.

A light source controller 72 controls operations of the light source for the central portion 123 and a light source 23, etc. For example, the light source controller 72 may control such that at least one of operation modes of the light source 23 and the light source for the central portion 123 is differentiated between when the operation corresponding to the pressing operation is valid and when the operation corresponding to the pressing operation is invalid in the central portion 21*f*.

Specifically, when the pressing operation to the central portion 21*f* of the operation portion 21, for example, corresponds to an operation for deciding a selected menu, and the like, the light source controller 72 turns on the light source for the central portion 123 to inform the user that the operation corresponding to the pressing operation to the central portion 21*f* is valid. That is, when such an operation is performed, the light source controller 72 may inform the user that it is a state in which there is any reaction (here, the reaction that decides a menu).

In the above, the light source controller 72 turns on only the light source for the central portion 123, but the invention is not limited thereto. For example, the light source controller 72 may turn on the light source 23 together with the light source for the central portion 123 to illuminate the whole of the operation portion 21. Thus, the light source controller 72 may inform the user that the operation corresponding to the pressing operation to the central portion 21*f* is valid.

When the operation corresponding to the pressing operation to the central portion 21*f* of the operation portion 21 is invalid, i.e., when it is a state in which there is no reaction, the light source controller 72 may turn off the light source for the central portion 123 to inform the user that the operation corresponding to the pressing operation to the central portion 21*f* is invalid.

As described above, the light source controller 72 controls the operation mode to correspond to the pressing operation to the central portion 21*f* so that the user may visually inspect and grasp whether the operation corresponding to the central portion 21*f* is valid or invalid by the mode of the illumination of the central portion 21*f*, and thus, the operability of the switch apparatus 10 is further improved.

MODIFICATION

Next, a modification will be described. In the embodiment described above, the operation portion 21 has an elongated shape, but the shape of the operation portion 21 is not limited thereto. Hereinafter, a first modification to a third modification will be described with reference to FIG. 11A to FIG. 11C. Each of FIG. 11A to FIG. 11C illustrates an operation portion to which light is emitted from a light source 23 in the same manner as FIG. 5.

First, the first modification will be described. FIG. 11A illustrates an operation portion 221 of a switch 20 according to a first modification. As illustrated in FIG. 11A, the operation portion 221 according to the first modification has a circular shape. The operation portion 221 is configured to receive a pressing operation of a user at an upper end 221*a*, a lower end 221*b*, a left end 221*c*, and a right end 221*d*.

Figure 11A:
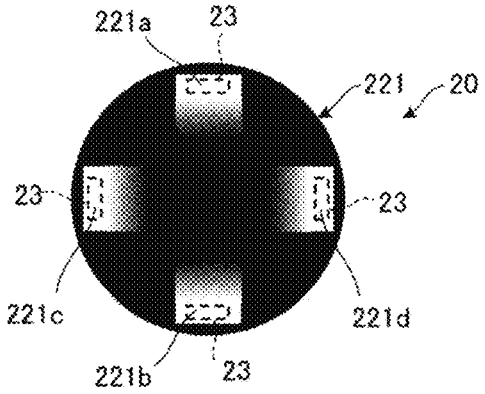
FIG. 11A illustrates an operation portion of a switch according to a first modification.
Figure 11B:
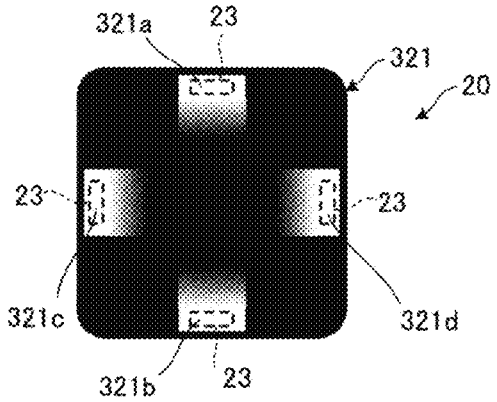
FIG. 11B illustrates an operation portion of a switch according to a second embodiment.
Figure 11C:
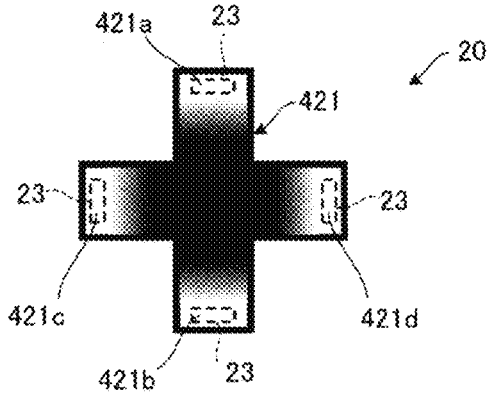
FIG. 11C illustrates an operation portion of a switch according to a third embodiment.

As shown by dashed lines in FIG. 11A, each of the light sources 23 is arranged on a back-surface side of each of the ends 221*a* to 221*d* of the operation portion 221 and emits light toward each of the ends 221*a* to 221*d*. As a result, according to the first modification, each of the ends 221*a* to 221*d* is brightly illuminated, and thus, an operability of a switch apparatus 10 is improved.

Next, the second modification will be described. FIG. 11B illustrates an operation portion 321 of a switch 20 according to the second embodiment. As illustrated in FIG. 11B, the operation portion 321 according to the second modification has a square shape (rectangular shape). The operation portion 321 is configured to receive a pressing operation of a user at an upper end 321*a*, a lower end 321*b*, a left end 321*c*, and a right end 321*d*.

As shown by dashed lines in FIG. 11B, each of the light sources 23 is arranged on a back-surface side of each of the ends 321*a* to 321*d* of the operation portion 321 and emits light toward each of the ends 321*a* to 321*d*. As a result, according to the second modification, each of the ends 321*a* to 321*d* is brightly illuminated, and thus, an operability of a switch apparatus 10 is improved.

Next, the third modification will be described. FIG. 11C illustrates an operation portion 421 of a switch 20 according to the third embodiment. As illustrated in FIG. 11C, the operation portion 421 according to the third modification has a cross shape. The operation portion 421 is configured to receive a pressing operation of a user at an upper end 421*a*, a lower end 421*b*, a left end 421*c*, and a right end 421*d*.

As shown by dashed lines in FIG. 11C, each of the light sources 23 is arranged on a back-surface side of each of the ends 421*a* to 421*d* of the operation portion 421 and emits light toward each of the ends 421*a* to 421*d*. As a result, according to the third modification, each of the ends 421*a* to 421*d* is brightly illuminated, and thus, an operability of a switch apparatus 10 is improved.

A number and positions of the portions that receive the pressing operations of the operation portions 221, 321 and 421 shown in the first to third modifications are merely examples and are not limited thereto. The number and positions of the portions may be arbitrarily set.

In the above, the light source controller 72 is configured to change an operation mode of the light source 23, etc. by turning on or off the light source 23, etc. or changing luminance of the light source 23, etc., but the invention is not limited thereto. The light source controller 72 may be configured to change other types of operation modes of the light source 23, etc. by changing a color of the light source 23, etc. or flashing the light source 23, etc.

For example, the light source controller 72 may change the luminance of the light source 23, etc. between daytime and night time.

In the above, the apparatus having an audio function has been described as an example of the in-vehicle apparatus 1, but the invention is not limited thereto. That is, as long as the in-vehicle apparatus 1 includes the switch apparatus 10, the in-vehicle apparatus 1 may be other types of in-vehicle apparatuses such as an air conditioner.

It is possible for a person skilled in the art to easily come up with more effects and modifications. Thus, a broader modification of this invention is not limited to specific description and typical embodiments described and expressed above. Therefore, various modifications are possible without departing from the general spirit and scope of the invention defined by claims attached and equivalents thereof.

While the invention has been shown and described in detail, the foregoing description is in all aspects illustrative and not restrictive. It is therefore understood that numerous other modifications and variations can be devised without departing from the scope of the invention.

What is claimed is:

1. A switch apparatus comprising:

an operation portion that has an elongated shape with first and second opposite ends in a longitudinal direction of the operation portion, receives a pressing operation of a user at least at one of the first and second ends, and is translucent;

a surface film that is formed on a surface of the operation portion and is translucent;

a first light source that is arranged on a back-surface side of the operation portion and emits light toward the at least one of the first and second ends; and a light source controller that controls an operation mode of the first light source according to an operation content corresponding to the pressing operation, wherein the operation portion is configured to receive the pressing operation at both of the first and second ends, and the light source controller controls such that the operation mode of the first light source is differentiated between one of the first and second ends at which the operation corresponding to the pressing operation is valid and the other of the first and second ends at which the operation corresponding to the pressing operation is invalid.

2. The switch apparatus according to claim 1, further comprising:

a second light source that is arranged on a back-surface side of a central portion of the operation portion in the longitudinal direction and emits the light toward the central portion, wherein the operation portion is configured to receive the pressing operation at the central portion.

3. An in-vehicle apparatus comprising:

the switch apparatus according to claim 1.

4. A switch apparatus comprising:

an operation portion that has an elongated shape with first and second opposite ends in a longitudinal direction of the operation portion, receives a pressing operation of a user at least at one of the first and second ends, and is translucent;

a surface film that is formed on a surface of the operation portion and is translucent;

a first light source that is arranged on a back-surface side of the operation portion and emits light toward the at least one of the first and second ends;

a second light source that is arranged on a back-surface side of a central portion of the operation portion in the longitudinal direction and emits the light toward the central portion; and a light source controller that controls such that at least one of operation modes of the first light source and the second light source is differentiated between when an operation corresponding to the pressing operation is valid and when the operation corresponding to the pressing operation is invalid in the central portion of the operation portion, wherein the operation portion is configured to receive the pressing operation at the central portion.

5. An in-vehicle apparatus comprising:

the switch apparatus according to claim 4.

* * * * *